US010220486B2

(12) United States Patent
Zhou et al.

(10) Patent No.: US 10,220,486 B2
(45) Date of Patent: Mar. 5, 2019

(54) DISC CONTAINING COPPER FOR SAPPHIRE POLISHING, AND METHOD FOR PREPARING DISCS CONTAINING COPPER FACING EACH OTHER

(71) Applicant: LENS TECHNOLOGY CO., LTD, Changsha (CN)

(72) Inventors: Qunfei Zhou, Changsha (CN); Qiaobing Rao, Changsha (CN); Liang Fu, Changsha (CN)

(73) Assignee: Lens Technology Co., Ltd., Changsha (CN)

( * ) Notice: Subject to any disclaimer, the term of this patent is extended or adjusted under 35 U.S.C. 154(b) by 95 days.

(21) Appl. No.: 15/319,867

(22) PCT Filed: Jun. 18, 2015

(86) PCT No.: PCT/CN2015/081779

§ 371 (c)(1),
(2) Date: Dec. 19, 2016

(87) PCT Pub. No.: WO2015/192784

PCT Pub. Date: Dec. 23, 2015

(65) Prior Publication Data

US 2017/0129071 A1 May 11, 2017

(30) Foreign Application Priority Data

Jun. 18, 2014 (CN) ..... 2014 1 0272515

(51) Int. Cl.
*B24D 7/02* (2006.01)
*B24B 37/14* (2012.01)
*B24B 37/16* (2012.01)

(52) U.S. Cl.
CPC ..... *B24B 37/16* (2013.01); *B24B 37/14* (2013.01); *B24D 7/02* (2013.01)

(58) Field of Classification Search
CPC ..... B24B 37/16; B24B 37/14; B24D 7/02
See application file for complete search history.

(56) References Cited

U.S. PATENT DOCUMENTS 4,037,367 A * 7/1977 Kruse ..... B24D 7/06 451/551
4,369,604 A * 1/1983 Kaganowicz ..... G11B 3/56 369/126

(Continued)

FOREIGN PATENT DOCUMENTS

CN 202174508 U 3/2012
CN 202428347 U 9/2012

(Continued)

OTHER PUBLICATIONS

Chinese International Searching Authority; International Search Report and Written Opinon for PCT/CN2015/081779, dated Aug. 25, 2015; 8 pages & English translation of the ISR; 1 page.

(Continued)

*Primary Examiner* — Pegah Parvini
(74) *Attorney, Agent, or Firm* — Henry Patent Law Firm PLLC

(57) ABSTRACT

A disc containing copper for sapphire polishing; the annular surface of the disc is provided with a spiral grinding groove or concentric circular grinding grooves thereon; and stepped grooves are provided at the edges along both the outer ring and inner ring of the annular surface of the disc. Also provided is a method of repairing discs containing copper facing each other for sapphire polishing, comprising: first step, horizontally and transversely moving an upper disc and a lower disc turning tool, or a lower disc and an upper disc turning tool, and aligning the turning tool with the original position of the grinding groove on the corresponding disc; second step, controlling the upper disc and the lower disc to rotate in opposite directions at the same rotation speed and (Continued)

with the turning tools fixed, controlling the upper disc or the lower disc to be fed transversely, and turning a corresponding grinding groove via the turning tools; third step, removing the turning tools and washing the surface of the corresponding discs.

15 Claims, 4 Drawing Sheets

(56) References Cited

U.S. PATENT DOCUMENTS

| | | | | |
|---|---|---|---|---|
| 6,660,124 | B1 | 12/2003 | Kawasaki et al. | |
| 2004/0020789 | A1* | 2/2004 | Hu | B23H 5/08 205/666 |
| 2011/0183579 | A1* | 7/2011 | Newelll | B24B 37/26 451/28 |
| 2012/0156970 | A1 | 6/2012 | Pietsch | |
| 2015/0017893 | A1* | 1/2015 | Rim | B24D 13/045 451/490 |

FOREIGN PATENT DOCUMENTS

| | | | |
|---|---|---|---|
| CN | 104044087 | A | 9/2014 |
| CN | 203918808 | U | 11/2014 |
| CN | 102240987 | B | 6/2016 |
| JP | 49125990 | | 2/1974 |
| JP | 2000233349 | | 8/2000 |
| JP | 2001138211 | | 5/2001 |
| JP | 2004090142 | | 3/2004 |
| JP | 2004243469 | | 9/2004 |
| JP | 2005271157 | | 10/2005 |
| JP | 2011044473 | A | 3/2011 |
| JP | 2011062762 | | 3/2011 |
| JP | 2011098396 | | 5/2011 |

OTHER PUBLICATIONS

JPO, Office Action issued in JP Pat. App. No. 2016-574123, dated Oct. 17, 2017, dated Oct. 17, 2017, 14 pgs.

* cited by examiner

A-A

DISC CONTAINING COPPER FOR SAPPHIRE POLISHING, AND METHOD FOR PREPARING DISCS CONTAINING COPPER FACING EACH OTHER

FIELD

The present disclosure belongs to the field of sapphire processing. In particular, the present disclosure relates to a disc containing copper for polishing sapphire and a method for repairing discs containing copper facing each other.

BACKGROUND

Sapphire is widely used for screen or protective panel of cell phone, laptop, watch, etc. due to its good physical and chemical properties and light transmittance. However, such application requires good flatness and therefore, has a high requirement for the flatness during the processing of sapphire panel. Usually, a grinding disc is needed in the process, together with slurry, for polishing.

Currently, the polishing disc is a metal disc, an alloy disc or a composite disc provided with coarse grinding grooves, the grinding groove cooperating with slurry for grinding and polishing sapphire. Disc containing copper is the best polishing disc for polishing sapphire. For example, a Chinese utility model patent with a publication number CN202174508U discloses a synthetic copper grinding disc, which is provided with several undulated grooves, the grooves being annular areas. However, the following problem exists when a double-face polisher to polish a sapphire panel. During the processing, referring to FIG. 1, the sapphire panel is placed within a mold cavity 5 of a planetary gear 3 that is located on a lower disc and forms planet trains by engaging with an inner gear ring 2 and a sun gear 4, respectively. The above utility model realizes single-face polishing of sapphire panel by rotation of a disc containing copper on one side, or double-face polishing of sapphire panel by the rotation in opposite directions of the upper and lower discs. The planetary gear 3 performs rotation and revolution via transmission of the planet trains so as to enhance the polishing effect. Currently, conventional sapphire panel is used for screen of cell phone and laptop, and is usually in a square shape as shown in FIG. 1. In the process that the sapphire panel placed on the planetary gear follows the rotation and revolution of the planetary gear, the shadow areas on the outer side and the inner side of the annular areas of the grinding grooves on the disc containing copper as shown in FIG. 1 is an intermittent grinding and polishing area where the edges and corners of the sapphire panel enters, and the middle position is a normal grinding and polishing area. After a period of polishing, as the hardness of sapphire is relatively high, the above two areas of the disc containing copper will have abrasion to different extent, which causes change in the flatness of the disc containing copper and makes the middle area lower than the circumferential areas. The error in the flatness of the grinding disc will directly lead to reduction of the flatness of the sapphire panels in the contact processing between the sapphire face and the grinding disc face. Severer, under the force applied by the upper polishing disc containing copper, the workpiece may be broken.

Therefore, a sapphire polishing disc containing copper needs to be researched and developed in this field, which will not generate uneven abrasion.

In addition, due to the high hardness of sapphire and the soft texture of copper, though copper grinding disc well performs the function of grinding sapphire, the grooves on the surface of the disc containing copper for grinding sapphire are easy to be worn flat by sapphire. Therefore, after a period of processing, the grinding grooves of the disc containing copper need to be repaired to enhance the sharpness to increase the processing efficiency. In order to repair conventional discs containing copper, at least one of the upper and lower discs that rotate in opposite directions needs to be removed from the polishing machine and be repaired by a special repairing machine. The labor intensity is rather high, and the works takes long labor hours, severely affecting the productivity of the manufacturing firm.

Therefore, a method for repairing discs containing copper facing each other for polishing sapphire which is more concise and convenient needs to be provided.

SUMMARY

The present application intends to solve the following technical problem: to provide a disc containing copper for polishing sapphire and a method for repairing discs containing copper facing each other. The disc containing copper for polishing of the present disclosure can effectively eliminate the quality defect in sapphire panel caused by inconsistent abrasion of the disc containing copper. And the method for repairing discs containing copper facing each other of the present disclosure can conveniently and rapidly complete the repair of the grinding grooves on the disc containing copper. Thus, the productivity is effectively increased.

The present disclosure may be realized by the following technical solution: a disc containing copper for polishing sapphire, an annular surface of the disc containing copper is provided with a spiral grinding groove or concentric circular grinding grooves thereon; and a stepped groove is provided at the edges along both the outer ring and the inner ring of the annular surface of the disc containing copper.

In the present disclosure, the stepped groove is also a groove recessed inward from the annular surface of the disc containing copper, like the grinding groove. However, merely one side of the stepped groove is recessed inward from the annular surface of the disc containing copper while the other side does not have a side wall or the top face corresponding to the side wall of the other side is lower than the annular surface of the disc containing copper. The grinding groove is a groove having both sides recessed inward from the annular surface of the disc containing copper. FIGS. 6-8 show the difference between the stepped groove and the grinding groove of the present disclosure. FIG. 6 illustrates the shape of step in the prior art, with reference sign 00 referring to an upper end surface of the step, 01 the first step and 02 the second step. FIG. 7 is a schematic diagram for the grinding groove of the present disclosure. A person skilled in the art knows that the shape of the side face of the grinding groove is not limited. The side face of the grinding groove can be in a triangular or a rectangular shape as shown in FIG. 7, with the lowest part in the recess of the grinding groove having side walls on both sides in a radial direction connecting to the annular surface of the disc containing copper. The bold line in the upmost part of FIG. 7 indicates the annular surface of the disc containing copper. FIG. 8 is a schematic diagram for the stepped groove of the present application, FIGS. 8(*a*) and 8(*b*) showing the stepped groove with one step and FIGS. 8(*c*) and 8(*d*) showing the stepped groove with two steps. Merely one side of the lowest part in the recess of the grinding groove has a side wall connecting in a radial direction to the annular surface of the disc containing copper. In the present application, the number of steps of the stepped groove is not limited. For example, the groove may have one step, two steps, three steps or more. However, it is preferred that the stepped groove has 1-2 steps.

Further, a width in the radial direction of the stepped groove along the outer ring of the annular surface of the disc containing copper may be no less than a minimal distance from an edge of a mold cavity of a planetary gear placed on the disc containing copper to an edge of the outer ring of the disc containing copper; and a width in the radial direction of the stepped groove along the inner ring of the annular surface of the disc containing copper should be no less than a minimal distance from an edge of the mold cavity of the planetary gear placed on the disc containing copper to an edge of the inner ring of the disc containing copper.

Furthermore, the depth of the grinding groove may be 0.25-0.35 mm; and the spacing between adjacent turns of the grinding groove or adjacent grinding grooves may be 1.2-1.4 mm. In the present disclosure, the depth of the stepped groove refers to the distance that the stepped groove is recessed inward from the annular surface of the disc containing copper 1 in a thickness direction of the disc containing copper 1. A person skilled in the art can understand that the width of the grinding groove in the radial direction is, for example, 0.3 mm.

Preferably, the disc containing copper is a disc composed of copper and resin; and the sapphire is a square-shaped sapphire panel.

Preferably, the spiral grinding groove is a single continuous groove.

Preferably, the stepped groove has a depth of 0.25-0.4 mm, and a radial width of 8-12 mm. In another specific example, the stepped groove may have a radial width of 3-8 mm, for example, 5-8 mm.

The present application also includes a method for repairing discs containing copper facing each other, wherein the discs containing copper are used to a polishing machine with two discs containing copper facing each other, the discs containing copper including an upper disc and a lower disc that rotate in opposite directions, wherein a lower disc turning tool is fixed to a position on one side of the upper disc and an upper disc turning tool is fixed to a position on a side of the lower disc opposing to the one side of the upper disc. The method for repairing the discs has the following steps: a first step of horizontally and transversally moving the upper disc and the lower disc turning tool, or the lower disc and the upper disc turning tool, so as to align the upper disc turning tool with the original position of a grinding groove on the upper disc and to align the lower disc turning tool with the original position of a grinding groove on the lower disc; a second step of controlling the upper disc and the lower disc to rotate in opposite directions at the same rotation speed and with the turning tools fixed, controlling the upper disc or the lower disc to be fed transversely, and cutting corresponding grinding grooves by the turning tools; and a third step of removing the turning tools and washing the surface of the discs containing copper.

In the present disclosure, "with the turning tools fixed" means that the connection between the turning tool and the connector (for example, a guide rail) for securing the turning tool is fixed, and the turning tool does not perform a circumferential movement with regard to the disc containing copper; but the turning tool can be transversely fed with regard to the disc containing copper. In fact, when the upper disc is controlled to be fed transversely, the lower disc turning tool provided on the same transversely movable means with the upper disc is simultaneously transversely fed, with the position of the lower disc and the upper disc turning tool unchanged in a transverse direction. When the lower disc is controlled to be fed transversely, the upper disc turning tool provided on the same transversely movable means with the lower disc is simultaneously transversely fed, with the position of the upper disc and the lower disc turning tool unchanged in a transverse direction.

In the present disclosure, except for performing necessary transverse feed along with the transverse guide rail, the turning tool no longer needs to be driven by a servo motor to perform a circumferential movement on the surface of the disc containing copper. The present disclosure changes the method for repairing the disc in the prior art by circumferential movement of the turning tool, and makes the process of repairing the disc more stabilized and the control of the method simpler.

In the method of the present disclosure, when the grinding groove is a spiral groove, in the second step of controlling the upper or lower disc to be transversely fed continually, the rotation speed and the transverse feeding speed of the discs containing copper are determined according to the size of the discs containing copper and the spacing and the number of turns of the spiral groove.

When the grinding groove is concentric circular grinding grooves, the upper or lower disc is in the second step is controlled to be transversely fed quantitatively at multiple times according to the spacing between the grinding grooves.

In specific, the lower disc and the upper disc turning tool are provided on a transverse guide rail on the polishing machine with two discs containing copper facing each other, and are driven by a motor to be fed transversely.

In specific, a horizontal distance from the lower disc turning tool to the edge of the upper disc equals to a horizontal distance from the upper disc turning tool to the edge of the lower disc; and a vertical distance from the tip of the upper disc turning tool to the upper disc equals to a vertical distance from the tip of the lower disc turning tool to the lower disc. Thus, the upper disc turning tool and the lower disc turning tool can be guaranteed to repair the corresponding disc simultaneously, and thereby enhances the grinding efficiency.

In specific, each disc of the discs containing copper facing each other is a disc for polishing sapphire with a stepped groove as described above. The stepped groove may be processed or finished with a corresponding turning tool in the same manner as the grinding groove is processed or finished. When the polishing grooves at a middle portion of the disc containing copper are worn to be leveled with the stepped grove, the stepped groove also can be repaired with the turning tool.

As shown above, a stepped groove is provided along the inner ring and the outer ring of the disc containing copper, respectively. During the polishing, the intermittent grinding and polishing area at these positions is reserved. Since the sapphire workpiece is provided within the planetary gear that is driven by an outer gear ring and the sun gear to revolve and rotate, the circumferential area of the sapphire workpiece can also be turned into the effective grinding area of the disc containing copper to be polished. Therefore, the whole of the areas on the copper plate provided with the grinding grooves is the normal grinding and polishing area. There will no longer be uneven wear in the area of the grinding groove on the disc containing copper, which effectively eliminates the defect of conventional polishing disc containing copper of uneven wear on the disc-containing-copper surface due to rapid wear in the middle and slow wear on the sides. Thus, the quality of the processed sapphire panel is ensured. Moreover, the present disclosure provides a method for quickly repairing discs containing copper facing each other using the double-face polishing machine of the disc containing copper, by which the grinding grooves of the upper and lower discs can be repaired at one time without removing any disc containing copper from the polishing machine, and the productivity is increased.

Further description of the present disclosure will be made referring to the drawings and examples.

BRIEF DESCRIPTION OF THE DRAWINGS

FIG. 8(*a*) and FIG. 8(*b*) illustrate a stepped groove having one step. FIG. 8(*c*) and FIG. 8(*d*) illustrate a stepped groove having two steps.

Figure 1:
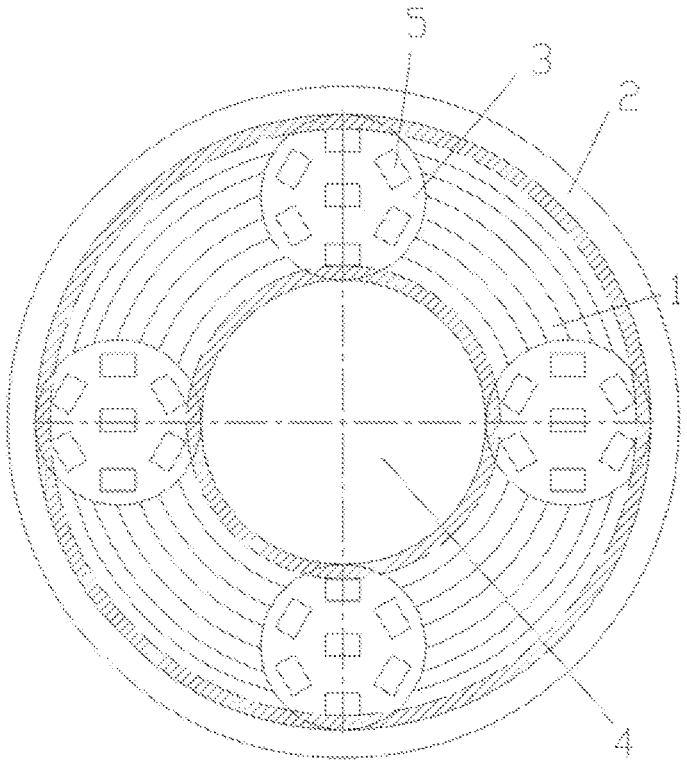
FIG. 1 is a schematic diagram for the polishing using a disc containing copper of the prior art.

Reference signs in the drawings: 1—disc containing copper; 2—inner gear ring; 3—planetary gear; 4—sun gear; 5—mold cavity; 6—transverse guide rail; 7—lower disc turning tool; 8—suspension arm; 9—upper disc turning tool; 11—grinding groove; 12—stepped groove.

EXAMPLES

The present application will be specifically described with the following examples. But the present application is not limited to the following examples.

Example 1

Figure 2:
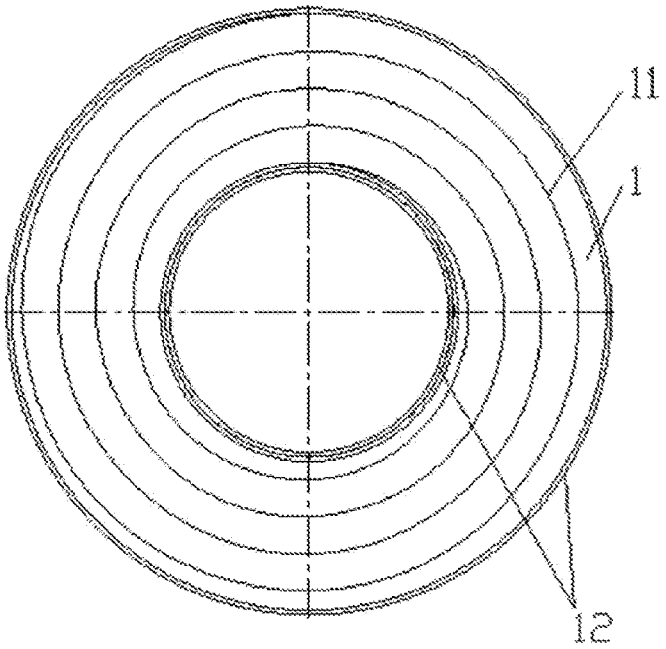
FIG. 2 is a top view of the disc containing copper for polishing sapphire in the present disclosure.
Figure 3:
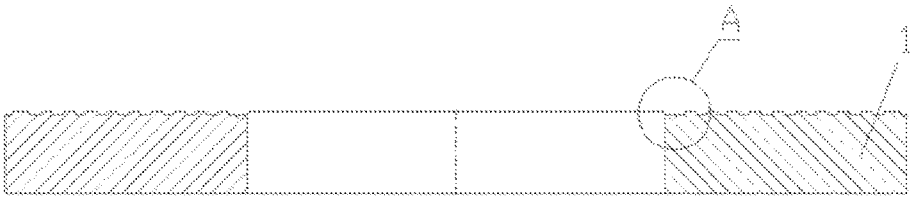
FIG. 3 is a front sectional view of the disc containing copper for polishing sapphire in the present disclosure.
Figure 4:
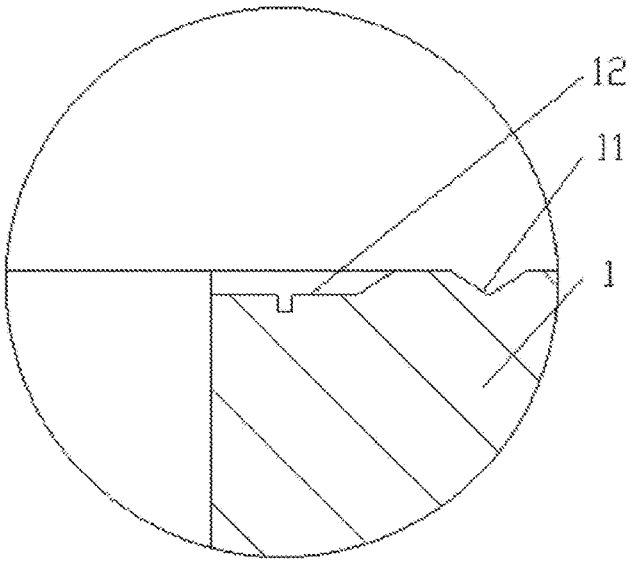
FIG. 4 is an enlarged view of the part indicated by A in FIG. 3.

Referring to FIGS. 2-4, a spiral grinding groove 11 is provided on the annular surface of the disc containing copper 1; a stepped groove 12 is provided along the edges of the annular outer and inner rings of the disc containing copper 1, respectively. A groove bottom surface of the stepped groove 12 is lower than the annular surface of the disc containing copper 1. FIG. 3 is a front sectional view of the disc containing copper for polishing sapphire in the present disclosure. FIG. 4 is an enlarged view of the part indicated by A in FIG. 3. However, a cross-sectional shape of the grinding groove in FIG. 3 is different from that in FIG. 4. In FIG. 3, the cross-sectional shape of the grinding groove is a rectangular shape while in FIG. 4, the cross-sectional shape of the grinding groove is a triangle. In addition, the stepped grooves along the edges of the inner and outer rings of the annular surface of the disc containing copper are both two-stepped grooves as shown in FIGS. 3 and 4. However, a person skilled in the art knows that the stepped groove may be a one-stepped groove or a multi-stepped groove.

Moreover, the grinding groove 11 can also use a concentric circular configuration, and be processed by cutting. The grinding groove 11 has a depth of 0.25-0.35 mm, and the spacing between the adjacent grinding grooves is 1.2-1.4 mm (FIG. 2 accentuates the spiral shape and is merely a schematic diagram, and does not illustrate the requirement for the size).

In specific, referring to the positional relationship with the planetary gear in FIG. 1, the outer stepped groove 12 should have a radial width that is no less than a minimal distance from the edge of the mold cavity of the planetary gear placed on the disc containing copper 1 to an outer edge of the annular disc containing copper; and a radial width of the inner stepped groove 12 should be no less than a minimal distance from the edge of the mold cavity of the planetary gear placed on the disc containing copper to an inner edge of the annular disc containing copper, so as to ensure that the whole area of the grinding grooves on the disc containing copper is the normal grinding area and to achieve even wear of the disc containing copper. Moreover, during the grinding and polishing process, the edges and corners of the sapphire panel will be circulated by the rotation of the planetary gear to enter the area of the disc containing copper provided with the grinding grooves so as to be grinded.

The disc containing copper 1 uses a disc composed of copper and resin which has a better polishing effect than a disc of pure copper.

Example 2

Figure 5:
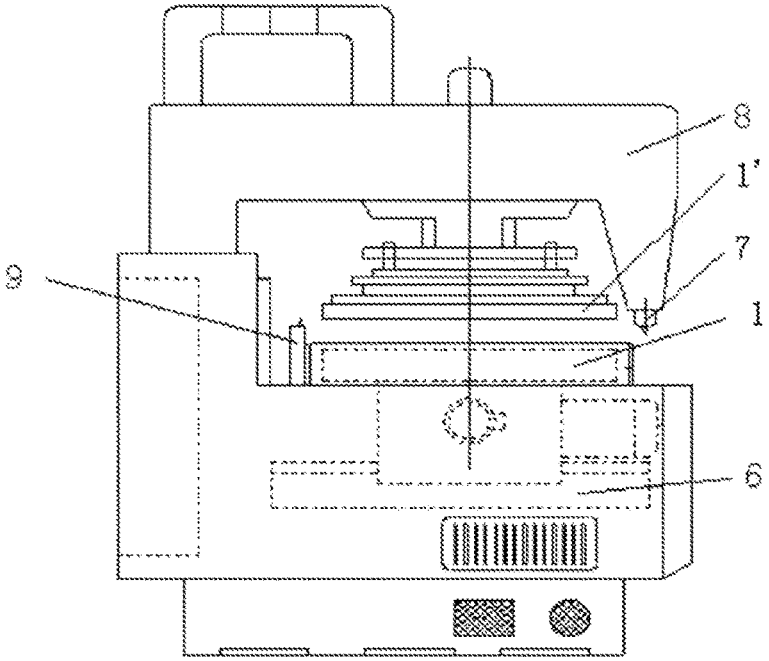
FIG. 5 is a schematic diagram of a polishing machine with two discs containing copper facing each other using the method for repairing discs containing copper facing each other of the present disclosure.
Figure 6:
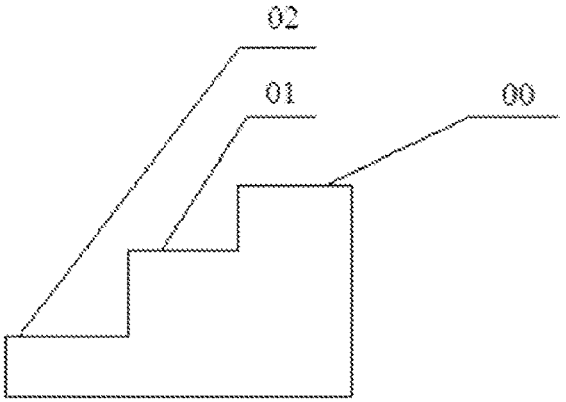
FIG. 6 is a schematic diagram of a step of the prior art.
Figure 7:
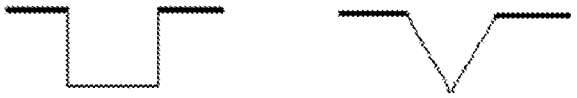
FIG. 7 is a schematic diagram of the grinding groove of the present disclosure.
Figure 8:
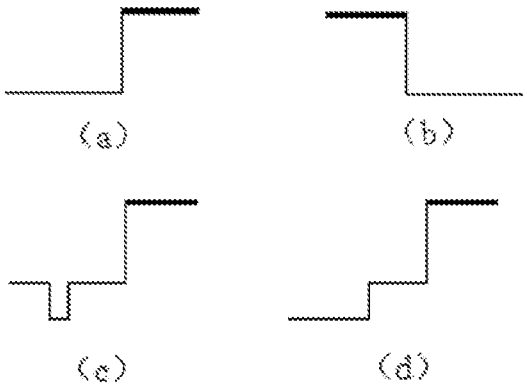
FIG. 8 is a schematic diagram of the stepped groove of the present disclosure.

The disc containing copper 1 of example 1 is applied to a polishing machine with two discs containing copper facing each other as shown in FIG. 5, the disc containing copper 1 having an upper disc 1' and a lower disc 1 that rotate in opposite directions. The upper disc 1' is provided above the lower disc 1 via a lifting suspension arm 8. A lower disc turning tool 7 pointing downward is fixed to the lifting suspension arm 8 on one side of the upper disc 1'; an upper disc turning tool 9 is fixed to a position on a side of the lower disc 1 that is opposing to the above one side of the upper disc 1'. In specific, the lower disc 1 and the upper disc turning tool 9 are provided on a transverse guide rail 6 of the polishing machine with two discs containing copper facing each other via a mounting seat, and are driven by a motor to be fed along the transverse guide rail 6, wherein, the upper disc turning tool 9 and the lower disc turning tool 7 are provided transversely along the direction of the guide rail, and the horizontal distance from the lower disc turning tool 7 to the edge of the upper disc 1' equals to a horizontal distance from the upper disc turning tool 9 to the edge of the lower disc 1; and a vertical distance from the tip of the upper disc turning tool 9 to the upper disc 1' equals to a vertical distance from the tip of the lower disc turning tool 7 to the lower disc 1. Thus, the upper disc turning tool and the lower disc turning tool can repair the corresponding disc simultaneously, and thereby enhances the grinding efficiency.

After the upper and lower discs are worn, the steps for repairing the discs are as follows: first, moving the upper disc 1' and the lower disc turning tool 7 in a vertical direction, and horizontally transversely moving the lower disc 1 and the upper disc turning tool 9 to align the turning tool with the original position of the grinding groove on the disc containing copper; second, controlling the upper disc 1' and the lower disc 1 to rotate in opposite directions at the same speed and with the turning tools fixed, and controlling the lower disc 1 and the upper disc turning tool 9 to be fed along the transverse guide rail 6 continually, repairing the grinding groove on the corresponding disc with the turning tools; third, removing the turning tools and washing away the residue on the corresponding disc-containing-copper surface.

In this example, the grinding groove is the continuous spiral groove of example 1. In the second step of controlling the lower disc to be transversely fed continually, the rotation speed and the transverse feeding speed of the disc containing copper are determined according to the size of the discs containing copper and the spacing and the number of turns of the spiral grooves. Specifically, as one example, the upper and lower discs have an outer diameter of 1070 mm and an inner diameter of 495 mm. The rotation speed of the upper and lower discs are 40 rpm (round per minute). The feeding speed of the lower disc is 0.30 mm/r (round). The process ultimately produces a continuous spiral grinding groove with a spacing of 1.3 mm and a groove depth of 0.30 mm.

Meanwhile, the stepped groove 12 of the disc containing copper in example 1 can also be processed with a corresponding turning tool. When the polishing groove at the middle part of the disc containing copper is worn flat with the stepped groove 12, the stepped groove can be repaired by the turning tool.

When the method of the present disclosure is applied to the repair of concentric circular grinding grooves, the method of multiple quantitative repairing can be performed; that is, after one circle of the grinding grooves is repaired at one time, the turning tool can be transversely fed by a gap of the groove to perform another turning. The specific parameters are determined according to the size of the discs containing copper and the grinding grooves, and will not be further described here.

Using the above method can realize automatic repairing the discs. The spiral grinding groove can be repaired and turned at one turning/time; and the concentric circular grinding grooves can be repaired through multiple turnings/times, saving the need for removing the grinding disc. The labor intensity is released, and the productivity is greatly increased.

While the present disclosure has been described with reference to exemplary examples, it is to be understood that within the spirit and scope defined by the following claims, all modifications of the present disclosure, in form and in detail, are included in the protection scope of the present disclosure.

What is claimed is:

1. A disc containing copper for polishing sapphire, wherein an annular surface of the disc containing copper is provided with a spiral grinding groove or concentric circular grinding grooves thereon, and stepped grooves are provided at edges along both an outer ring and an inner ring of the annular surface of the disc containing copper.

2. The disc containing copper for polishing sapphire according to claim 1, wherein a width in a radial direction of the stepped groove along the outer ring of the annular surface of the disc containing copper is no less than a minimal distance from an edge of a mold cavity of a planetary gear placed on the disc containing copper to an edge of the outer ring of the disc containing copper; and a width in a radial direction of the stepped groove along the inner ring of the annular surface of the disc containing copper is no less than a minimal distance from the edge of the mold cavity of the planetary gear placed on the disc containing copper to an edge of the inner ring of the disc containing copper.

3. The disc containing copper for polishing sapphire according to claim 2, wherein the grinding groove has a depth of 0.25-0.35 mm, and a spacing between adjacent turns of the grinding groove or adjacent grinding grooves is 1.2-1.4 mm.

4. The disc containing copper for polishing sapphire according to claim 3, wherein the disc containing copper is a disc composed of copper and resin.

5. The disc containing copper for polishing sapphire according to claim 1, wherein the spiral grinding groove is a single continuous groove.

6. The disc containing copper for polishing sapphire according to claim 1, wherein the stepped groove has a depth of 0.25-0.4 mm and a radial width of 8-12 mm.

7. A method for repairing discs containing copper facing each other for polishing sapphire, wherein the discs containing copper are used in a polishing machine with two discs containing copper facing each other, an annular surface of the disc containing copper is provided with a spiral grinding groove or concentric circular grinding grooves thereon, and stepped grooves are provided at edges along both an outer ring and an inner ring of the annular surface of the disc containing copper, the discs containing copper including an upper and a lower disc, and wherein a lower disc turning tool for repairing the lower disc is fixed to a position on one side of the upper disc, and an upper disc turning tool for repairing the upper disc is fixed to a position on a side of the lower disc opposing to the one side of the upper disc, the method comprising: a first step of moving horizontally and transversally the upper disc and the lower disc turning tool, or the lower disc and the upper disc turning tool, so as to align the upper disc turning tool with the original position of the grinding groove on the upper disc and to align the lower disc turning tool with the original position of the grinding groove on the lower disc; a second step of controlling the upper disc and the lower disc to rotate in opposite directions at the same rotation speed and with the turning tools fixed, controlling the upper disc or the lower disc to be fed transversely, and cutting corresponding grinding grooves by the turning tools; and a third step of removing the turning tools and washing the surface of the discs containing copper.

8. The method for repairing discs containing copper facing each other for polishing sapphire according to claim 7, wherein the grinding groove is a spiral groove, and the upper or lower disc is controlled to be transversely fed continually in the second step.

9. The method for repairing discs containing copper facing each other for polishing sapphire according to claim 7, wherein the grinding groove has concentric circular grinding grooves, the upper or lower disc is controlled to be transversely fed quantitatively at multiple times according to the spacing between the grinding grooves in the second step.

10. The method for repairing discs containing copper facing each other for polishing sapphire according to claim 8, wherein the lower disc and the upper disc turning tool are provided on a transverse guide rail on the polishing machine with two discs containing copper facing each other, and are driven by a motor to be fed transversely.

11. The method for repairing discs containing copper facing each other for polishing sapphire according to claim 10, wherein a horizontal distance from the lower disc turning tool to the edge of the upper disc equals to a horizontal distance from the upper disc turning tool to the edge of the lower disc, and a vertical distance from a tip of the upper disc turning tool to the upper disc equals to a vertical distance from a tip of the lower disc turning tool to the lower disc.

12. The method for repairing discs containing copper facing each other for polishing sapphire according to claim 7, wherein each disc of the discs containing copper facing each other is the disc containing copper for polishing sapphire according to claim 1.

13. The method for repairing discs containing copper facing each other for polishing sapphire according to claim 12, wherein the stepped groove is processed or finished by a corresponding turning tool with the same method as the grinding groove is processed or finished.

14. The method for repairing discs containing copper facing each other for polishing sapphire according to claim 9, wherein the lower disc and the upper disc turning tool are provided on a transverse guide rail on the polishing machine with two discs containing copper facing each other, and are driven by a motor to be fed transversely.

15. The method for repairing discs containing copper facing each other for polishing sapphire according to claim 14, wherein a horizontal distance from the lower disc turning tool to the edge of the upper disc equals to a horizontal distance from the upper disc turning tool to the edge of the lower disc, and a vertical distance from a tip of the upper disc turning tool to the upper disc equals to a vertical distance from a tip of the lower disc turning tool to the lower disc.

* * * * *